United States Patent [19]

Masumoto et al.

[11] Patent Number: 4,781,771

[45] Date of Patent: Nov. 1, 1988

[54] AMORPHOUS CO-BASED METAL FILAMENTS AND PROCESS FOR PRODUCTION OF THE SAME

[75] Inventors: Tsuyoshi Masumoto, No. 8-22, Uesugi 3-chome, Sendai-shi, Miyagi; Akihisa Inoue, Miyagi; Michiaki Hagiwara; Kiyomi Yasuhara, both of Kyoto, all of Japan

[73] Assignees: Unitika Ltd., Hyogo; Tsuyoshi Masumoto, Miyagi, both of Japan

[21] Appl. No.: 947,711

[22] Filed: Dec. 30, 1986

Related U.S. Application Data

[60] Continuation of Ser. No. 720,325, Apr. 5, 1985, abandoned, which is a division of Ser. No. 597,569, Apr. 9, 1984, Pat. No. 4,527,614, which is a continuation of Ser. No. 311,207, Oct. 14, 1981, abandoned.

[30] Foreign Application Priority Data

Oct. 16, 1980 [JP] Japan ..... 55-144860

[51] Int. Cl.[4] ..... C22C 19/07

[52] U.S. Cl. ..... 148/403; 148/304; 420/435; 420/436; 420/440; 420/580; 420/581; 420/588

[58] Field of Search ..... 148/304, 403; 428/606; 420/435, 436, 440, 580, 581, 588

[56] References Cited

U.S. PATENT DOCUMENTS 3,856,513 12/1974 Chen et al. ..... 420/435
4,030,892 6/1977 Mendelsohn ..... 148/403
4,052,201 10/1977 Polk et al. ..... 420/581
4,056,411 11/1977 Chen et al. ..... 420/435
4,137,075 1/1979 Ray et al. ..... 420/580
4,482,400 11/1984 O'Handley ..... 148/31.55

OTHER PUBLICATIONS

"The American Heritage Dictionary of the English Language", 1976, p. 1469.

*Primary Examiner*—John P. Sheehan
*Attorney, Agent, or Firm*—Sughrue, Mion, Zinn, Macpeak & Seas

[57] ABSTRACT

An amorphous Co-based metal filament having a circular cross-section made of an alloy composed mainly of Co-Si-B or Co-Me-Si-B (wherein Me is at least one metal selected from the group consisting of Fe, Ni, Cr, Ta, Nb, V, Mo, Mn, W and Zr). This filament is produced by jetting the above alloy into a rotating member containing therein a cooling liquid through a spinning nozzle having a hole diameter which is determined according to the amorphous metal-forming ability (critical thickness to form an amorphous phase) to thereby cool-solidify the jetted molten alloy and form a filament, and then winding the filament continuously on the inner walls of the rotating member by the rotary centrifugal force thereof. This amorphous metal filament is corrosion resistant, is tough and has high electromagnetic characteristics, and is very useful as industrial materials, such as electric and electronic parts, composite materials and fibrous materials.

4 Claims, 1 Drawing Sheet

AMORPHOUS CO-BASED METAL FILAMENTS AND PROCESS FOR PRODUCTION OF THE SAME

This is a continuation of application Ser. No. 720,325, filed Apr. 5, 1985, now abandoned, which is a division of application Ser. No. 597,569 filed Apr. 9, 1984, now U.S. Pat. No. 4,527,614, which is a continuation of application Ser. No. 311,207 filed Oct. 14, 1981, now abandoned.

FIELD OF THE INVENTION

The present invention relates to amorphous Co-based metal filaments having a circular cross-section and a process for the production of the same.

BACKGROUND OF THE INVENTION

A method of producing metal filaments directly from molten metal is an inexpensive method of producing metal filaments. If such metal filaments have an amorphous structure, there would be a great possibility that they could be put into practical use in many applications such as electric and electronic parts, composite materials, and fibrous materials since they have excellent chemical, electrical and physical characteristics. Particularly, in the case of amorphous alloys, the foregoing characteristics can be further improved in comparison with crystal metals and crystal alloys which have heretofore been put into practical use by appropriately choosing the alloy composition. In particular, they have great advantages in corrosion resistance, toughness, and high electromagnetic properties. Thus, there is a great possibility that they are novel materials.

These amorphous metals are already known as described in, for example, *Nippon Kinzoku Gakkai Po* (*Journal of Japanese Metal Association*), No. 3, Vol. 15 (1976), *Science,* No. 8 (1978), and N. J. Grant and B. C. Giessen, Ed., *Proceedings of the 2nd International Conference,* Elsenier Sequoia S. A., Lausanne (1976).

It has thus been highly desired to produce high quality filaments having a circular cross-section from amorphous metals having such excellent characteristics by a convenient melt spinning method.

Alloys which can be used at present to produce amorphous metal filaments having a circular cross-section by spinning a molten alloy directly into a cooling liquid and solidifying the alloy therein are limited to those having a critical cooling temperature of about $10^{3°}$ C./sec., such as a $Pd_{77.5}$-$Cu_6$-$Si_{16.5}$ based alloy (atomic %), as described in *Scripta Metallurgica,* Vol. 13, pp. 463–467 (1979).

The difficulty encountered in making alloys amorphous varies greatly depending on the type of metal and the composition. In particular, an Fe, Ni and Co based alloy which is important as a practical material has a critical cooling rate ranging between about $10^{5°}$ C./sec. and $10^{6°}$ C./sec. and, thereofre, the cooling rate thereof in a cooling liquid is low. It has thus been believed that it is difficult to produce amorphous metal filaments having a circular cross-section from an Fe, Ni and Co based alloy.

At present, for the production of amorphous Fe, Ni and Co based alloy, those methods having a high cooling rate, such as a gun method, a piston-anvil method, a roll chilling method, a centrifugal chilling method, and a plasma jet method, are employed. In accordance with the foregoing methods except for the roll chilling method and the centrifugal chilling method, only amorphous plate-like materials can be obtained. Even using the roll chilling method and centrifugal chilling method, only definite ribbon-like filaments can be obtained, and these filaments have the disadvantage that they cannot be used in other than special applications because of the flat cross-section thereof.

Methods of producing such ribbon-like amorphous metal filaments are known as described in the foregoing literatures concerning amorphous alloys, Japanese patent application (OPI) No. 91014/74 (corresponding to U.S. Pat. No. 3,856,513) (the term "OPI" as used herein refers to a "published unexamined Japanese patent application"), Japanese patent application (OPI) Nos. 125228/78, 125229/78 and 88219/77, Japanese patent publication No. 50727/77, Japanese patent application (OPI) Nos. 101203/75 and 4017/76, Japanese patent application (OPI) No. 109221/76 (corresponding to German patent application (OLS) No. 2,606,581 and French Pat. No. 2,301,605), Japanese patent application (OPI) Nos. 12719/78 and 12720/78, Japanese patent application (OPI) No. 133826/77 (corresponding to German patent application (OLS) No. 2,719,710 and French Pat. No. 2,350,159), and Japanese patent application (OPI) No. 88220/77.

The conventional method of producing amorphous metal filaments is based on the principle of injecting a molten metal onto the surface of a chilling member, and therefore, the metal filament is inevitably flat at the areas which come into contact with the chilling member, and it has been not possible at all to produce filaments having a circular cross-section. Although an attempt to produce filaments having a circular cross-section by providing the roll surface with round cavities (a continuous narrow cavity having a depth of a several ten μm to a several hundred μm on the roll surface) and injecting a molten metal thereonto was made, there is only a very limited possibility of success since many technical problems arise, for example, it is not possible to inject the molten metal accurately into the very narrow cavity.

A number of methods of producing metal filaments having a circular cross-section directly from a molten metal have been developed.

In accordance with one of the methods, a very instable low viscosity metal stream is cooled and solidified while continuity is retained. That is, this method is based on the same system as melt-spinning which is employed at present for mass-production of synthetic fibers. For example, Japanese patent publication No. 24013/70 discloses, as a stabilization technique for such cooling-solidification, a method in which a molten metal is spun into an atmosphere of a gas reactive with the metal to thereby form an oxidized or nitrided coating film on the molten filament surface. It has been discovered, however, that it is quite difficult to stabilize the molten metal to the same level as in the case of the solidified state only by the formation of such coating films. In addition, this method can be applied only to those specific metals capable of forming oxidized or nitrided coating films.

Japanese patent publication No. 25374/69 discloses a very useful technique for cooling a molten metal. That is, it discloses an important method in which fusing agent particles are sprayed into an ionization region produced by corona discharge such that they float in an inert gas, and the molten metal is cooled and solidified utilizing the latent heat of the fusing agent.

Cooling methods similar to the method disclosed in Japanese patent publication No. 25374/69 are described in, for example, Japanese patent application (OPI) Nos. 56560/73 and 71359/73. In accordance with these methods, a molten metal is spun into bubbles or air bubbles, and cooled and solidified therein. In all of these methods, however, the cooling-solidification rate is very low, and chemical or electrostatic stabilization of a spun stream is still insufficient.

Another cooling method is described in *Kasen Geppo* (*Monthly Reports of Chemical Fibers*), No. 7, p. 61 (1974). This cooling method is a composite metal-spinning method utilizing the stringiness of glass, in which a metal such as copper and silver in the form of a chip is placed in a glass tube, and the glass tube and metal are heated and melted with a dielectric heating coil, and withdrawn from a lower portion with a glass rod which has been previously heated and then wound. This composite metal-spinning method, however, is effective only in a specific combination of the melt viscosity of glass and the melting temperature of metal, and is not applicable to all metals. The structure of each of the melting zone and spinning nozzle zone is complicated because of composite spinning and at the same time, high precision is required. Furthermore, when such spun products are used as metal filaments, it is necessary to remove the glass coating film remaining on the periphery thereof. This leads to an increase in production cost, and many problems still remain to be solved before the industrialization thereof.

In addition, a method of producing metal filaments by injecting a spun molten metal into a cooling liquid running in parallel therewith has been proposed as described in Japanese patent application (OPI) No. 135820/74. In this method, however, the cooling ability is, as described hereinafter in detail, insufficient since the spun molten metal and the cooling liquid run in parallel with each other at the same rate and at the same time, at a low rate of 200 m/minute or less. Furthermore, since the cooling liquid is a stream spontaneously falling due to gravity, the impact of the spun molten metal on the cooling liquid, and the boiling and convection of the cooling liquid resulting from the impact make it very difficult to maintain the cooling liquid and the surface thereof in a stabilized state. It is thus not possible to produce high quality amorphous filaments having a circular cross-section. Furthermore, it is technically very difficult to wind up the solidified filament continuously and directly.

Furthermore, a method of producing fine continuous lead wires having a circular cross-section by placing a cooling liquid in a rotary drum, forming a liquid film on the inner walls of the rotary drum by centrifugal force, and jetting molten lead into the liquid film is described in Preliminary Report Title No. 331 at '78 Autumn Conference (No. 83, Toyama) of Japanese Metal Association, and Japanese patent application (OPI) No. 64948/80. This method, however, can be applied only to low melting point metals having good stringiness, such as lead. In particular, under conditions where the jetting rate of the molten metal stream is higher than the rotation rate of the drum, which are described in the literature to be essential in the practice of the method, it is not possible at all to produce high quality fine continuous wires of amorphous alloys. Furthermore, the continuous lead wire produced by the method is not amorphous, has a low cross-sectional roundness (no accurate circular cross-section), is bent, and has high size irregularity in the longitudinal direction. Thus, it is not suitable for practical use.

Using alloys prepared by adding various metalloids or semimetals to Fe, Ni and Co metal elements which are important as practical materials, investigations have now been made to find which metal element exhibits an excellent fine wire-forming ability when it is melted and then solidified by chilling through the introduction thereof into a rotating cooling liquid in a molten form. As a result, it has been found that almost all Ni-based alloys are formed into spherical shots when they are introduced into the rotating cooling liquid, and the fine wire-forming ability thereof is inferior. Furthermore, it has been found that Fe-based alloys which are most inexpensive from the standpoint of starting material costs have an excellent fine wire-forming ability, and that Co-based alloys have a fine wire-forming ability which is slightly inferior to those of the Fe-based alloys.

The term "fine wire-forming ability" as used herein indicates the property of a metal to form uniform continuous filaments having a circular cross-section and without size irregularity in the longitudinal direction when it is spun into a rotating cooling liquid in the form of a molten metal stream and cool-solidified therein.

Hereinafter, the fine wire-forming ability will be described in detail with reference to representative alloys.

It is known that an Ni-Si-B alloy, which is a typical example of Ni-based alloys, very easily provides uniform amorphous continuous flat filaments using a centrifugal chilling method. However, even if the molten metal stream of the Ni-Si-B alloy is spun into a rotating cooling liquid and cool-solidified therein, almost no uniform filament-like product is obtained, and almost all of the molten metal stream is formed into spherical shots.

Also, a $Pd_{82}$-$Si_{18}$ alloy (atomic %) having a low critical cooling rate of $1.8\times10^{3}$° C./sec. has a poor fine wire-forming ability and when solidified by chilling in a rotating cooling liquid, almost all of the alloy is formed into spherical shots. A Pd-Cu-Si alloy prepared by adding Cu to the above Pd-Si alloy has an excellent fine wire-forming ability, and it is possible to produce therefrom amorphous continuous filaments having a very high uniformity and a circular cross-section. This alloy, however, is very expensive.

Hereinafter, the relation between the fine wire-forming ability and the semimetal contributing to the formation of an amorphous alloy will be explained.

The fine wire-forming ability in a rotating cooling liquid varies markedly depending on the type and combination of semimetal elements. For example, the order of the fine wire-forming ability in a rotating cooling liquid of alloys prepared by adding semimetals to Fe and Co metal elements having an excellent fine wire-forming ability is as follows:

$$\text{Fe-Si-B} \geqq \text{Fe-P-Si} \geqq \text{Co-Si-B} \geqq \text{Fe-P-C}$$

On the other hand, Fe-P-B and Fe-C-B alloys have almost no fine wire-forming ability.

As described above, it is apparent that the fine wire-forming ability in a rotating cooling liquid varies markedly depending on the type of the metal element and semimetal element. Although the reason for this is not at present completely understood, it is believed that the viscosity, surface tension, and cooling rate of the molten metal stream and the physical and chemical action thereof with the rotating cooling liquid are factors.

Furthermore, as in the case of the fine wire-forming ability, the amorphous metal-forming ability varies markedly depending on the type of the semimetal added. In general, the amorphous metal-forming ability increases in the following order:

$$\text{Fe-Si-B} \geqq \text{Fe-P-C} > \text{Co-Si-B} >> \text{Fe-P-Si}$$

On the other hand, with the Fe-P-Si alloy, uniform continuous fine wires can be obtained, but because of the low amorphous metal-forming ability thereof, it is difficult to obtain continuous fine wires which are amorphous.

A method of producing amorphous metal filaments having a circular cross-section using those alloys composed mainly of Fe which is an important material for practical use by jetting an alloy having an amorphous metal-forming ability through a spinning nozzle into a rotating member containing therein a cooling liquid to thereby cool-solidify the spun filament and by winding up the filament onto the inner walls of the rotating member by the rotary centrifugal force of the rotating member wherein the circumferential speed of the rotating member is maintained at the same level as that at which the molten metal is jetted, or alternatively maintained at a higher level than that has been proposed and filed as U.S. Ser. No. 254,714, filed Apr. 16, 1981, now abandoned.

These alloys composed mainly of Fe, however, have disadvantages in that in producing continuous filaments therefrom, problems arise such as plugging of the nozzle and a reduction in the service life of the nozzle during the spinning. In particular, an alloy composed mainly of Fe-P-C tends to be easily oxidized during the spinning and cool-solidification steps. Also, an alloy composed mainly of Fe-Si-B tends to have inferior corrosion resistance. On the other hand, those alloys composed mainly of Co are almost free from the above-described disadvantages, although the fine wire-forming ability and amorphous metal-forming ability thereof are slightly inferior. In particular, they have excellent electromagnetic performance and, therefore, they are useful alloys for the production of electric and electronic parts. Using such useful alloys, however, high quality amorphous metal filaments having a circular cross-section have not yet been produced.

SUMMARY OF THE INVENTION

An object of the invention is to provide amorphous Co-based metal filaments having a circular cross-section which are inexpensive, are corrosion resistant, are tough, and have high electromagnetic characteristics, and therefore, are useful as industrial materials, such as electric and electronic parts, composite materials, and fibrous materials.

Another object of the invention is to provide a process for producing such high quality amorphous Co-based metal filaments economically and easily.

As a result of extensive studies to achieve the above objects, it has been found that when a Co-based alloy having an amorphous metal-forming ability is jetted through a spinning nozzle having a specific hole diameter, and cool-solidified in a rotating member containing therein a cooling liquid while at the same time winding up the resulting filament, amorphous Co-based metal filaments having a circular cross-section can be obtained.

The present invention, therefore, provides:

(1) An amorphous Co-based metal filament having a circular cross-section which comprises 20 atomic percents or less of Si (hereinafter all percents are atomic percents), 7 to 35% of B, the total of Si and B being 13 to 40%, and the remainder composed substantially of Co, and has a wire diameter satisfying the following equation (I):

$$D_F \geqq 190 - 8|Si-11| - 8|B+0.8Si-25| \quad \text{(I)}$$

where $D_F$ is the wire diameter (μm) of a filament, Si is the atomic percent of Si in the alloy, and B is the atomic percent of B in the alloy;

(2) An amorphous Co-based metal filament having a circular cross-section which comprises 20% or less of Si, 7 to 35% of B, 30% or less of at least one metal selected from the group consisting of Fe, Ni, Cr, Ta, Nb, V, Mo, Mn, W and Zr, and the remainder composed substantially of Co, provided that the total of Si and B is 13 to 40%, Fe is 30% or less, Ni is 20% or less, Cr is 10% or less, Ta is 10% or less, Nb is 10% or less, V is 10% or less, Mo is 5% or less, Mn is 5% or less, W is 5% or less, and Zr is 5% or less, and which has a wire diameter satisfying the following equation (II):

$$D_F \geqq K - 8|Si-11| - 8|B+0.8Si-25| \quad \text{(II)}$$

where $D_F$ is the wire diameter (μm) of a filament, K is a constant as determined depending on the additional metal element with which a part of the Co metal element is replaced:

when Fe, Ni, Mo, Mn, W or Zr is added, K=190;
when Nb, Cr or V is added, K=300; and
when Ta is added, K=400 provided that when two or more elements are added, K is the maximum value, and Si and B are, respectively, the atomic percents of Si and B in the alloy;

(3) A process for producing an amorphous Co-based metal filament having a circular cross-section which comprises jetting an alloy comprising 20% or less of Si, 7 to 35% of B, the total of Si and B being 13 to 40%, and the remainder composed mainly of Co into a rotating member containing therein a cooling liquid through a spinning nozzle having a hole diameter satisfying the equation (III):

$$D_N \leqq 190 - 8|Si-11| - 8|B+0.8Si-25| \quad \text{(III)}$$

where $D_N$ is the hole diameter (μm) of the spinning nozzle, Si is the atomic percent of Si in the alloy, and B is the atomic percent of B in the alloy, to thereby cool-solidify spun filaments therein, and winding up the resulting filament onto the inner walls of the rotating member due to the rotary centrifugal force thereof; and (4) A process for producing an amorphous Co-based metal filament having a circular cross-section which comprises jetting an alloy comprising 20% or less of Si, 7 to 35% of B, 30% or less of at least one metal selected from the group consisting of Fe, Ni, Cr, Ta, Nb, V, Mo, Mn, W and Zr, and the remainder composed substantially of Co, provided that the total of Si and B is 13 to 40%, Fe is 30% or less, Ni is 20% or less, Cr is 10% or less, Ta is 10% or less, Nb is 10% or less, V is 10% or less, Mn is 5% or less, Mo is 5% or less, W is 5% or less, and Zr is 5% or less, into a rotating member containing therein a cooling liquid through a spinning nozzle having a hole diameter ($D_N$) satisfying the equation (IV):

$$D_N \leqq K-8|Si-11|-8|B+0.8Si-25| \quad (IV)$$

where $D_N$ is the hole diameter (μm) of the spinning nozzle, K is a constant as determined depending on the additional metal element with which a part of the Co metal element is replaced:
when Fe, Ni, Mn, Mo, W or Zr is added, K=190;
when Nb, Cr or V is added, K=300; and
when Ta is added, K=400
provided that when two or more elements are added, K is the maximum value, and Si and B are, respectively, the atomic percents of Si and B in the alloy, to thereby cool-solidify spun filaments therein, and winding up the resulting filament onto the inner walls of the rotating member due to the rotary centrifugal force thereof.

In accordance with the process of the invention, amorphous Co-based metal filaments having a circular cross-section can be produced easily and economically. These amorphous Co-based metal filaments are inexpensive, are corrosion resistant, are tough, and have high electromagnetic characteristics, and therefore, are useful as industrial materials such as electric and electronic parts, composite materials and fibrous materials.

DETAILED DESCRIPTION OF THE INVENTION

Figure 1:
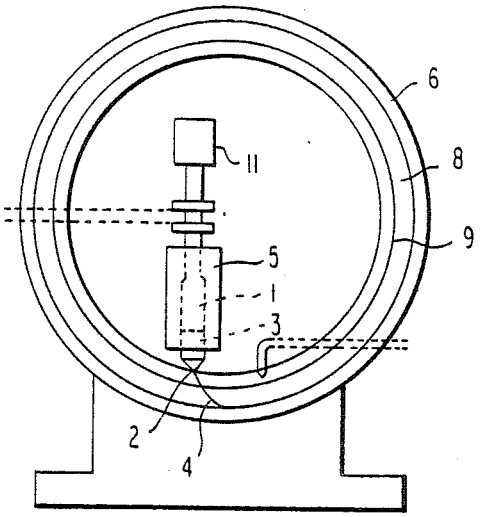
FIGS. 1 and 2 are each a schematic illustration of an embodiment of an apparatus oriented horizontally for use in the invention.

The Co-based alloy for use in the practice of the invention comprises 20% or less of Si, 7 to 35% of B, the total of Si and B being 13 to 40%, and the remainder composed substantially of Co, or alternatively 20% or less of Si, 7 to 35% of B, 30% or less of at least one metal selected from the group consisting of Fe, Ni, Cr, Ta, Nb, V, Mo, Mn, W and Zr, and the remainder composed substantially of Co. Conventionally used materials in producing alloys can be employed to achieve the components recited above in the Co-based alloy of this invention.

The proportions of Si and B in the Co-Si-B alloy greatly influence the amorphous metal-forming ability. That is, in order to produce amorphous Co-based metal filaments by cool-solidifying the Co-Si-B alloy in a rotating cooling liquid, the Si content must be 20% or less, the B content must be 7 to 35%, and the total of Si and B must be 13 to 40%. In particular, it is preferred for the total of Si and B to be 13 to 35%.

Furthermore, it is necessary that the hole diameter $D_N$ (μm) of the spinning nozzle is designed so that it satisfies the equation (III) shown below.

$$D_N \leqq 190-8|Si-11|-8|B+0.8Si-25| \quad (III)$$

where $D_N$ is the hole diameter (μm) of the spinning nozzle, Si is the atomic percent of Si in the alloy, and B is the atomic percent of B in the alloy.

The wire diameter $D_F$ (μm) of the filament produced by the use of the spinning nozzle is the same as or slightly smaller than the hole diameter $D_N$ (μm) of the spinning nozzle. In particular, when the Si content and B content are near 11% and 16%, respectively, the amorphous metal-forming ability is the highest, and it is possible to produce amorphous Co-based continuous filaments having a wire diameter of 190 μm and a circular cross-section. When the Si and B contents are either increased or decreased, the amorphous metal-forming ability is reduced.

Even though the Co-Si-B alloy is melt-spun by the use of a spinning nozzle having a hole diameter $D_N$ which does not satisfy the equation (III) and cool-solidified in a rotating cooling liquid, only those filaments can be obtained which have a crystalline structure, are brittle, and do not have the characteristics of amorphous metals. The practical value of such filaments, therefore, is poor.

When a part of the Co metal element in the foregoing Co-Si-B alloy is replaced with Fe and Ni, if the Fe and Ni contents are 30% or less, and 20% or less, respectively, the electromagnetic characteristics of the Co-Si-B alloy can be improved without plugging the nozzle, and a reduction in the service life of the spinning nozzle, oxidation resistance, corrosion resistance, and the like occurring.

Also, by replacing a part of the Co metal element in the Co-Si-B alloy with Cr, Ta, Nb, V, Mo, Mn, W and Zr, the heat resistance and strength of the Co-Si-B alloy can be increased. When Cr, Ta, Nb and V are used, if the content of each metal is 10% or less, the amorphous metal-forming ability can also be increased markedly without very much reduction in the fine wire-forming ability in the rotating cooling liquid occurring.

Addition of Nb, Cr or V permits amorphous Co-based metal filaments having a circular cross-section and a maximum diameter of about 300 μm to be produced. Also, addition of Ta permits amorphous Co-based metal filaments having a diameter of about 400 μm to be produced. When Mn, Mo, W and Zr are used, if the content of each metal is 5% or less, it is possible to produce high quality continuous Co-based metal filaments having a circular cross-section without reducing very much the amorphous metal-forming ability and fine wire-forming ability. The total content of such metal elements with which a part of the Co metal element can be replaced without a marked reduction of the amorphous metal-forming ability and fine wire-forming ability is 30% or less. In addition, other metals and semimetals, such as Al, Cu, Pd, Hf, P, C, and Ge, can be added within the range that the amorphous metal-forming ability and fine wire-forming ability are not reduced markedly.

In producing amorphous Co-based filaments using a Co-Me-Si-B alloy by cool-solidifying the alloy in a rotating cooling liquid, it is necessary for the spinning nozzle hole diameter $D_N$ (μm) as determined depending on the amorphous metal-forming ability of the alloy to satisfy the equation (IV) below:

$$D_N \leqq K-8|Si-11|-8|B+0.8Si-25| \quad (IV)$$

where $D_N$ is the hole diameter (μm) of the spinning nozzle, K is a constant as determined according to an additional metal element with which a part of the Co metal element is replaced:
when Fe, Ni, Mn, Mo, W or Zr is added, K=190;
when Nb, Cr or V is added, K=300; and
when Ta is added, K=400 provided that when two or more elements are added, K is the maximum value, and Si and B are, respectively, the atomic percents of Si and B in the alloy, and Si is 20% or less, B is 7 to 35%, and the total of Si and B is 13 to 40%.

The wire diameter $D_F$ (μm) of the filament produced by the use of the spinning nozzle as described above is the same as or slightly smaller than the hole diameter $D_N$ (μm) of the spinning nozzle. The wire diameter $D_F$ range (μm) is about 400 μm or less, preferably several μm to 400 μm, most preferably 5 μm to 400 μm.

If a Co-Me-Si-B alloy is melt-spun and cool-solidified in a rotating cooling liquid by the use of a spinning nozzle having a hole diameter $D_N$ which does not satisfy the equation (IV), only those filaments are obtained which have a crystalline structure, are brittle, and do not have the characteristics of amorphous metals. The practical value of such filaments is poor.

The cooling liquid as used herein is a pure liquid, solution, emulsion or the like, which can form a stable surface on reacting with the spun molten metal, or is chemically unreactive with the spun molten metal. In order to produce uniform amorphous Co-based metal continuous filaments having a circular cross-section, it is desired to employ those cooling liquids which have a suitable cooling rate ability, which (including the liquid surface thereof) are stable and are not disturbed, and the cooling rate of which can further be increased by stirring. In particular, water maintained at ordinary temperature or lower temperatures than the ordinary temperature, and those aqueous electrolyte solutions with water, metal salt or the like dissolved therein, which are maintained at ordinary temperature (e.g., 20° to 30° C.) or lower temperatures (in the case of water, the temperature of the ordinary temperature to 0° C. and in the case of metal salt, the temperature of the ordinary temperature to a freezing point thereof, e.g., −20° to −60° C.) than the ordinary temperature, are preferred. The preferred examples of suitable liquids in an emulsion form are a sorbitol ester, a triethanolamine oleate, a petroleum sulfonic acid.

It is believed that the course of chilling a molten metal by bringing it into contact with a cooling liquid can be generally considered to occur in three stages.

The first stage is a period during which a vapor film of the cooling liquid covers all of the metal. In the first stage, cooling is performed by radiation through the vapor film and, therefore, the cooling rate is relatively low. In the second stage, the vapor film is broken, vigorous boiling occurs continuously, and heat is removed mainly as heat of evaporation. The cooling rate, therefore, is highest in the second stage. In the third stage, the boiling stops, the cooling is performed by conduction and convection, and therefore, the cooling rate is again reduced.

In order to perform cooling rapidly, therefore, it is most effective to employ the following procedures:

(1) A cooling liquid is selected which permits the first stage to be shortened as much as possible and to reach the second stage rapidly.

(2) The cooling liquid or molten metal to be cooled is moved as quickly as possible by a suitable technique to break the vapor film of the first stage and to permit the second stage to be reached promptly.

It can be fully understood from, for example, the fact that the cooling rate of water, when water is stirred vigorously, is increased to about four times that of water in a stationary state. In order to increase the cooling rate, the cooling liquid must have a high boiling point and a high latent heat for evaporation, i.e., so that the cooling can be accelerated, and must have high fluidity because of easy dissipation of vapor or air bubbles. In addition, of course, the cooling liquid must be inexpensive and is free from deterioration.

Furthermore, in order to break promptly the vapor film in the first stage by application of a suitable technique to thereby permit moving to the cooling of the second stage, and furthermore, in order to always maintain the cooling liquid and the liquid surface thereof stable, the cooling liquid preferably is introduced into the rotating member, and in order to increase the cooling rate, preferably a cooling liquid having a high specific heat is employed, the rotation rate of the rotating member is increased, the rate at which the molten metal is jetted through the spinning nozzle is increased, the introduction angle of the spun molten metal relative to the liquid surface of the cooling liquid is increased, and the distance between the spinning nozzle and the liquid surface of the cooling liquid is shortened.

The term "introduction angle of the spun molten metal relative to the surface of the cooling liquid" is used in the invention to indicate an angle between the spun molten metal and a tangential line at the point that the spun molten metal first reaches the surface of the cooling liquid.

Figure 2:
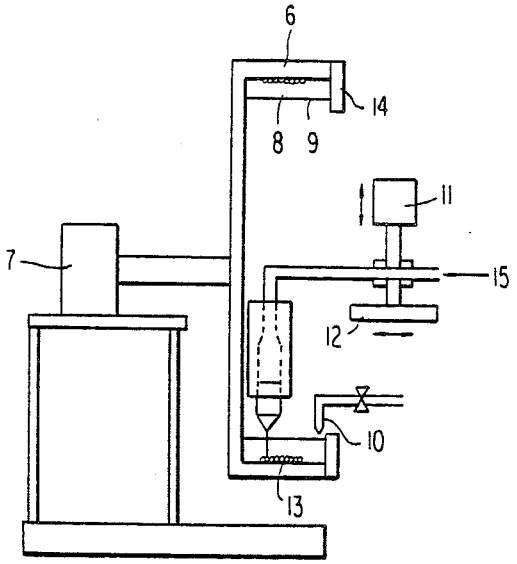
Figure 3:
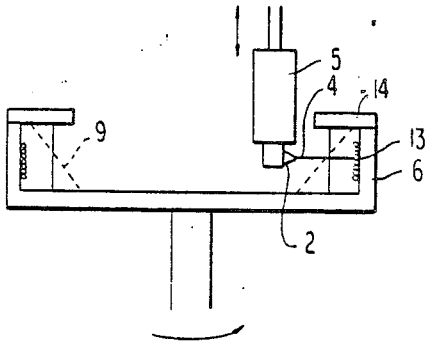
FIG. 3 is a schematic illustration of an embodiment of an apparatus oriented vertically for use in the invention.

The invention is explained in greater detail below by reference to the accompanying drawings wherein FIGS. 1 and 2 are each a schematic illustration of an embodiment of an apparatus oriented horizontally for use in the invention, and FIG. 3 is a schematic illustration of an embodiment of an apparatus oriented vertically for use in the invention.

Reference numeral 1 indicates a crucible in which a starting metal 3 to be melt-spun is placed. The crucible 1 is made of a suitable heat-resistant substance, such as a ceramic, e.g., quartz, zirconia, alumina, and boron nitride. The crucible 1 is provided with a nozzle 2 having at least one spinning hole, the diameter of which is nearly equal to the desired diameter of the metal filaments. The nozzle 2 is made of a heat-resistant substance as in the case of the crucible 1. Examples of such substances include ceramics, such as quartz, zirconia, alumina, and boron nitride, and synthetic ruby and sapphire.

Reference numeral 5 indicates a heating furnace to heat-melt the starting metal 3 to be melt spun; 6 indicates a rotating drum which is driven by a driving motor 7; and 8 indicates a cooling liquid which forms a liquid surface 9 on the inner side of the rotating drum 6 due to rotary centrifugal force. Reference numeral 10 indicates a tube through which the cooling liquid 8 is supplied or withdrawn.

The type and temperature of the cooling liquid 8 are determined taking into account the heat capacity of the molten metal 4. The heat capacity of the molten metal 4 increases in direct proportion to the temperature, specific heat, latent heat for melting, and sectional area thereof. It is, therefore, desired that as the heat capacity of the molten metal 4 increases, the temperature of the cooling liquid is decreased, or the specific heat, density, evaporation heat, and thermal conductivity of the cooling liquid is increased. In addition, it is desired for the cooling liquid to have a low viscosity and to be inflammable so as to minimize splitting of the molten metal 4 in the cooling liquid, and furthermore, to be inexpensive.

A typical example of such cooling liquids is water maintained at ordinary temperature or at lower temperatures than the ordinary temperature. In general, however, since high quality amorphous metal filaments can be easily produced when the cooling rate is increased, an aqueous electrolyte solution cooled to ordinary temperature or lower temperatures than the ordinary temperature, such as a 10 to 25% by weight aqueous solution of sodium chloride, a 5 to 15% by weight aqueous solution of sodium hydroxide, a 10 to 25% by weight aqueous solution of magnesium chloride, and a 50% by weight aqueous solution of zinc chloride, is preferably used.

The introduction angle of the molten metal 4 relative to the cooling liquid surface 9, and the rotation of the rotating drum 6 may be in any direction.

The rate at which the molten metal 4 is jetted through the spinning nozzle 2, and the rate of the rotating drum 6 greatly influence the fine wire-forming ability. It is preferred for the circumferential speed of the rotating drum 6 to be equal to or higher than the rate at which the molten metal 4 is jetted through the spinning nozzle 2. In particular, it is preferred for the circumferential speed of the rotating drum 6 to be controlled to be 5 to 30% higher than the rate at which the molten metal 4 is jetted through the spinning nozzle 2.

The circumferential speed of the rotating drum 6 is preferably 300 m/min or more from the standpoints of holding the cooling liquid in a stable manner in the rotating drum and of increasing the cooling rate. The upper limit of the circumferential speed is preferably about 800 m/min in an industrial practice.

The introduction angle is preferably 20° or more. The distance between the spinning nozzle 2 and the cooling liquid surface 9 is preferably shortened as much as possible within the range that the turbulence, breaking and cutting of the spun molten metal 4 do not occur. A distance of 10 mm or less is particularly preferred.

Reference numeral 11 indicates an air piston which supports the crucible 1 and moves it upward and downward, and the reference numeral 12 indicates a device which moves the crucible 1 left and right at a constant speed and which permits the cool-solidified metal filament to be wound continuously and regularly on the inner walls of the rotating drum 6.

FIG. 3 shows an apparatus which is mechanically the same as the apparatus of FIG. 1 or 2 except that it is oriented vertically. The advantages of the vertically oriented apparatus shown in FIG. 3 are: (1) it is not necessary to supply or withdraw the cooling liquid, and (2) a uniform cooling liquid surface can be formed at a very low rotation speed. On the other hand, when the rotation speed is changed, the angle of the cooling liquid surface is changed. In the case of low-speed rotation, the cooling liquid surface moves in the direction indicated by the dotted line. Furthermore, in order to make the spun molten metal vertical to the cooling liquid surface, it is necessary to bend the spinning nozzle portion.

Reference numeral 14 indicates a masking shield removably mounted on the rotating drum 6, and it is preferably a transparent plate which permits easy observation of the condition in which the spun filament is wound up. The starting metal 3 is introduced into the crucible 1 through an inlet thereof by a technique, such as gas fluid transfer, and is melted by heating in a heating furnace 5. At the same time, the rotation speed of the rotating drum 6 is set to a predetermined level by the use of the driving motor 7, and the cooling liquid is supplied to the inner side of the rotating drum 6 through a cooling liquid-supplying pipe 10. Then, the spinning nozzle 2 is lowered with the device 12 and air piston 11 to the position shown in FIGS. 1 and 2 so that it faces the cooling liquid surface 9, and at the same time, gas pressure is applied onto the starting metal 3 to thereby introduce the molten metal 4 toward the cooling liquid surface 9. In order to prevent oxidation of the starting metal 3, an inert gas 15, such as argon gas, is always introduced into the interior of the crucible 1 to thereby keep it in an inert atmosphere. The metal introduced into the cooling liquid surface 9 moves through the cooling liquid 8 by the combined force of the jetting direction, rotation direction of the rotating drum, and centrifugal force, cool-solidified therein, and wound up regularly with the device 12 on the inner walls of the rotating drum 6, or on the inner side of metal filaments 13 which have already been cool-solidified and laminated on the inner walls of the rotating drum 6.

When the spinning is completed, the top of the cooling liquid withdrawal pipe 10 is inserted into the cooling liquid 8 to thereby withdraw the cooling liquid. When the rotation of the rotating drum 6 is stopped and the masking shield 14 is removed, high quality amorphous metal filaments 13 having a circular cross-section can be obtained on the inner walls of the rotating drum 6. These filaments wound in such a form can be used as an article as it is. Depending on the amount being used, it is, of course, possible to rewind the filament in a suitable amount.

The term "circular cross-section" as used herein means that the ratio of minor axis diameter (Rmin) to major axis diameter (Rmax) (i.e., Rmin/Rmax) of the same cross-section is 0.7 or more. X-ray diffraction analysis was employed to determine whether or not the metal filament obtained had an amorphous structure.

The following examples are given to illustrate the invention in greater detail. Unless otherwise indicated, all percents are atomic percents.

EXAMPLES 1 TO 16 AND COMPARATIVE EXAMPLES 1 TO 14

A horizontal rotation drum having an inner diameter of 500 mm as illustrated in FIGS. 1 and 2 was employed. An alloy having the metal composition shown in Table 1 (atomic percents) was melted in an atmosphere of argon at a temperature which was 70° C. higher than the melting point of the alloy, jetted through a spinning nozzle (ruby) having a hole diameter D (μm) shown in Table 1 at a rate of 400 m/min which was adjusted by controlling argon gas pressure, and introduced into water (5° C.) having a depth of 25 mm. The speed of the rotating drum was 440 m/min, and the introduction angle was 75°. The thus-jetted molten metal was quickly cool-solidified in the cooling water while at the same time lodged continuously on the inner walls of the rotating drum by centrifugal force. At this time, the distance between the spinning nozzle and the cooling liquid surface was maintained at 5 mm. The rate at which the molten metal was jetted was determined by the amount of metal which was collected after being jetted into the air for a predetermined time.

The fine wire-forming ability and the results of X-ray diffraction analysis are shown in Table 1 along with the alloy composition and hole diameter D (μm) of the spinning nozzle.

TABLE 1

| Run No. | Alloy Composition (atomic %) | Hole Diameter of Nozzle (μm) | Fine Wire-Forming Ability Roundness (%) | Fine Wire-Forming Ability Size Unevenness (%) | X-Ray Diffraction Analysis |
|---|---|---|---|---|---|
| 1. Comparative Example 1 | $Co_{72.5}$—$Si_{12.5}$—$B_{15}$ | 200 | 88 | 8.5 | Crystalline |
| 2. Example 1 | " | 165 | 92 | 6.0 | Amorphous |
| 3. Comparative Example 2 | $Co_{70}$—$Si_{10}$—$B_{20}$ | " | 87 | 9.5 | Crystalline |
| 4. Example 2 | " | 130 | 91 | 5.5 | Amorphous |
| 5. Comparative Example 3 | $Co_{67.5}$—$Si_{7.5}$—$B_{25}$ | " | 90 | 10.0 | Crystalline |
| 6. Example 3 | " | 100 | 92 | 7.5 | Amorphous |
| 7. Comparative Example 4 | $Co_{80}$—$Si_{5}$—$B_{15}$ | " | 89 | 10.5 | Crystalline |
| 8. Example 4 | " | 60 | 90 | 6.5 | Amorphous |
| 9. Example 5 | $Co_{65}$—$Si_{5}$—$B_{30}$ | " | 91 | 7.0 | " |
| 10. Example 6 | $Co_{62.5}$—$Si_{7.5}$—$B_{30}$ | " | 91 | 7.5 | " |
| 11. Comparitive Example 5 | $(Co_{0.70}$—$Ni_{0.30})_{72.5}$—$Si_{12.5}$—$B_{15}$ | 150 | Almost spherical shot | | — |
| 12. Example 7 | $(Co_{0.75}$—$Ni_{0.25})_{72.5}$—$Si_{12.5}$—$B_{15}$ | 150 | 84 | 13 | Amorphous |
| 13. Comparative Example 6 | $(Co_{0.85}$—$Cr_{0.15})_{72.5}$—$Si_{12.5}$—$B_{15}$ | 250 | Almost spherical shot | | — |
| 14. Example 8 | $(Co_{0.90}$—$Cr_{0.10})_{72.5}$—$Si_{12.5}$—$B_{15}$ | " | 86 | 9.5 | Amorphous |
| 15. Example 9 | $(Co_{0.95}$—$Cr_{0.05})_{72.5}$—$Si_{12.5}$—$B_{15}$ | " | 90 | 7.0 | " |
| 16. Comparative Example 7 | $(Co_{0.85}$—$Ta_{0.15})_{72.5}$—$Si_{12.5}$—$B_{15}$ | 350 | Almost spherical shot | | — |
| 17. Example 10 | $(Co_{0.90}$—$Ta_{0.10})_{72.5}$—$Si_{12.5}$—$B_{15}$ | " | 84 | 11 | Amorphous |
| 18. Comparative Example 8 | $(Co_{0.85}$—$Nb_{0.15})_{72.5}$—$Si_{12.5}$—$B_{15}$ | 250 | Almost spherical shot | | — |
| 19. Example 11 | $(Co_{0.90}$—$Nb_{0.10})_{72.5}$—$Si_{12.5}$—$B_{15}$ | " | 85 | 12 | Amorphous |
| 20. Comparative Example 9 | $(Co_{0.85}$—$V_{0.15})_{72.5}$—$Si_{12.5}$—$B_{15}$ | " | Almost spherical shot | | — |
| 21. Example 12 | $(Co_{0.95}$—$V_{0.05})_{72.5}$—$Si_{12.5}$—$B_{15}$ | " | 88 | 12 | Amorphous |
| 22. Comparative Example 10 | $(Co_{0.95}$—$V_{0.05})_{72.5}$—$Si_{12.5}$—$B_{15}$ | 300 | 87 | 13 | Crystalline |
| 23. Comparative Example 11 | $(Co_{0.90}$—$Mn_{0.10})_{72.5}$—$Si_{12.5}$—$B_{15}$ | 165 | Almost spherical shot | | — |
| 24. Example 13 | $(Co_{0.95}$—$Mn_{0.05})_{72.5}$—$Si_{12.5}$—$B_{15}$ | " | 86 | 11 | Amorphous |
| 25. Comparative Example 12 | $(Co_{0.92}$—$Mo_{0.08})_{70}$—$Si_{10}$—$B_{20}$ | 120 | 84 | 12 | Crystalline |
| 26. Example 14 | $(Co_{0.97}$—$Mo_{0.03})_{70}$—$Si_{10}$—$B_{20}$ | " | 89 | 7.5 | Amorphous |
| 27. Comparative Example 13 | $(Co_{0.90}$—$W_{0.10})_{70}$—$Si_{10}$—$B_{20}$ | " | Almost spherical shot | | — |
| 28. Example 15 | $(Co_{0.95}$—$W_{0.05})_{70}$—$Si_{10}$—$B_{20}$ | " | 87 | 10 | Amorphous |
| 29. Comparative Example 14 | $(Co_{0.92}$—$Zr_{0.08})_{70}$—$Si_{10}$—$B_{20}$ | " | 82 | 13 | Crystalline |
| 30. Example 16 | $(Co_{0.97}$—$Zr_{0.03})_{70}$—$Si_{10}$—$B_{20}$ | " | 89 | 6 | Amorphous |

In Run Nos. 1, 3, 5, 7 and 22, since spinning nozzles whose hole diameter D (μm) did not satisfy the equation (II) were used in Run Nos. 1, 3, 5 and 7, and the equation (IV) in Run No. 22, no amorphous filament could be obtained.

Run Nos. 11 to 30 are tests in which alloys prepared by replacing a part of the Co metal element with Ni, Cr, Ta, Nb, V, Mn, Mo, W or Zr were used. In Run Nos. 11, 13, 16, 18, 20, 23 and 27, however, the amount of the Co metal element which was replaced with the other metals was large, falling outside the range defined for the invention. Therefore, the fine wire-forming ability was reduced, and no filament which could be used for X-ray diffraction analysis was obtained.

In Run Nos. 25 and 29, although the fine wire-forming ability was not reduced very much, the amorphous metal-forming ability was reduced, and amorphous filament could not be obtained.

The size unevenness in the longitudinal direction was measured as follows:

The diameter of a filament sample having a length of 10 m was measured randomly at ten points. The difference between the maximum diameter and the minimum diameter was divided by the average diameter, and multiplied by 100.

X-ray diffraction analysis was carried out using $FeK_{\alpha}$ irradiation.

EXAMPLE 17

A metal filament was produced in the same manner as in Example 1 except that an alloy comprising 75% (atomic percents) of Co, 10% of Si, and 15% of B was melted in an atmosphere of argon, jetted under an argon gas pressure of 4.5 kg/cm$^2$G through a spinning nozzle having a hole diameter (D) of 130 μm, and introduced at a rotating drum speed of 500 m/min and an introduction angle of 65°. The rate at which the molten metal was jetted was 450 m/min. A high quality amorphous filament having an average diameter of 120 μm, a roundness of 92%, and a size unevenness in the longitudinal direction of 6.0% was thus obtained.

The filament thus-produced had excellent mechanical and thermal properties, for example, a tensile strength of 330 kg/mm$^2$ and a crystallization temperature of 490° C. Furthermore, even though the filament was allowed to stand in the air at room temperature for a half year, no change (brittleness) was observed at all.

EXAMPLE 18

A high quality fine filament having an average diameter of 185 μm, a roundness of 90%, and a size unevenness in the longitudinal direction of 6.5% was produced in the same manner as in Example 17 except that an alloy comprising 67% (atomic percents) of Co, 8% of Cr, 10% of Si, and 15% of B was melted in an atmosphere of argon and jetted under an argon gas pressure of 3.5 kg/cm$^2$G through a spinning nozzle having a hole diameter (D) of 200 μm. When the thus-produced filament was subjected to X-ray diffraction analysis utilizing Fe$K_\alpha$ irradiation, only a broad diffraction peak which was characteristic of the amorphous state was observed. The mechanical strength and the crystallization temperature of the thus-produced filament were 380 kg/mm$^2$ and 570° C., respectively. This indicates that an effect due to addition of Cr was produced.

EXAMPLE 19

An alloy comprising 60% (atomic percents) of Co, 7% of Ni, 8% of Fe, 10% of Si, and 15% of B was melted in an argon atmosphere in the same manner as in Example 17 to thereby obtain a high quality fine filament which had an average diameter of 120 μm, a roundness of 92%, and a size unevenness in the longitudinal direction of 6.0%, and which had a small magnetic loss, a large effective permeability, and a small change with temperature of the effective permeability over a wide temperature range. When the thus-produced filament was subjected to X-ray diffraction analysis utilizing Fe$K_\alpha$ irradiation, only a broad diffraction peak which was characteristic of the amorphous state was observed.

EXAMPLE 20

An alloy comprising 47.5% (atomic percents) of Co, 25% of Fe, 12.5% of Si, and 15% of B was melted in an argon atmosphere, jetted through a spinning nozzle having a hole diameter of 150 μm at a rate of 540 m/min under an argon gas pressure of 5.0 kg/cm$^2$G, and introduced into an 18% aqueous solution of sodium chloride having a depth of 35 mm and cooled to −15° C. The speed of the rotating drum was 600 m/min, and the introduction angle was 80°. The jetted molten metal was quenched and solidified in the aqueous solution of sodium chloride maintained at −15° C. while at the same time being lodged continuously on the inner walls of the rotating drum by centrifugal force. The thus-produced filament had an average diameter of 135 μm, a roundness of 94%, a size unevenness of 5.5%, and a strength of 350 kg/mm$^2$. When the filament was subjected to X-ray diffraction analysis utilizing Fe$K_\alpha$ irradiation, only a diffraction peak which was characteristic of the amorphous state was observed.

COMPARATIVE EXAMPLE 15

An alloy comprising 37.5% (atomic percents) of Co, 35% of Fe, 12.5% of Si, and 15% of B was jetted under the same conditions as in Example 19. In the course of the spinning, however, the holes of the nozzle were gradually blocked, and it was impossible to jet the molten alloy continuously until the final stage.

While the invention has been described in detail and with reference to specific embodiments thereof, it will be apparent to one skilled in the art that various changes and modifications can be made therein without departing from the spirit and scope thereof.

What is claimed is:

1. An amorphous Co-based metal filament having a circular cross-section and made of an alloy comprising 5 to 20 atomic percent of Si and 7 to 35 atomic percent of B, the total of Si and B being 13 to 40 atomic percent and the remainder being composed substantially of Co, and which has a wire diameter satisfying the following equation (I):

$$D_F \leqq 190 - 8|Si - 11| - 8|B + 0.8Si - 25| \quad \text{(I)}$$

wherein $D_F$ is the wire diameter, in μm, of the filament, Si is the atomic percent of Si in the alloy, and B is the atomic percent of B in the alloy, said filament having a size unevenness in the longitudinal direction of 13% or less.

2. An amorphous Co-based metal filament having a circular cross-section and made of an alloy comprising 5 to 20 atomic percent of Si, 7 to 35 atomic percent of B, and 30 atomic percent or less of at least one metal selected from the group consisting of Fe, Ni, Cr, Ta, Nb, V, Mo, Mn, W and Zr, the remainder being composed substantially of Co, provided that the total of Si and B is 13 to 40 atomic percent, Fe is 30 atomic percent or less, Ni is 20 atomic percent or less, Cr is 10 atomic percent or less, Ta is 10 atomic percent or less, Nb is 10 atomic percent or less, V is 10 atomic percent or less, Mo is 5 atomic percent or less, Mn is 5 atomic percent or less, W is 5 atomic percent or less, and Zr is 5 atomic percent or less, and which has a wire diameter satisfying the equation (II):

$$D_F \leqq K - 8|Si - 11| - 8|B + 0.8Si - 25| \quad \text{(II)}$$

where $D_F$ is the wire diameter, in μm, of a filament, K is a constant as determined depending on an additional metal element with which a part of the Co metal element is replaced:

when Fe, Ni, Mo, Mn, W or Zr is added, K=190,
when Nb, Cr or V is added, K=300, and
when Ta is added, K=400, provided that when two or more metal elements are added, the K value is the maximum value, Si is the atomic percent of Si in the alloy, and B is the atomic percent of B in the alloy, said filament having a size unevenness in the longitudinal direction of 13% or less.

3. The amorphous Co-based metal filament as claimed in claim 1, wherein the total of Si and B is 13 to 35 atomic percent.

4. The amorphous Co-based metal filament as claimed in claim 2, wherein the total of Si and B is 13 to 35.

* * * * *